United States Patent [19]

Arndt et al.

[11] Patent Number: 5,031,365

[45] Date of Patent: Jul. 16, 1991

[54] METHOD AND APPARATUS FOR GRINDING THE RUNNING AND/OR GUIDE SURFACES OF RAILS OR THE LIKE

[75] Inventors: Gerhard Arndt, Munich; Hans Guntermann, Essen, both of Fed. Rep. of Germany

[73] Assignee: Elektro-Thermit GmbH, Essen, Fed. Rep. of Germany

[21] Appl. No.: 441,762

[22] Filed: Nov. 27, 1989

[30] Foreign Application Priority Data

Nov. 26, 1988 [DE] Fed. Rep. of Germany ..... 3840006

[51] Int. Cl.[5] ..... E01B 31/17

[52] U.S. Cl. ..... 51/178

[58] Field of Search ..... 51/178, 135 R, 142, 51/141, 143, 328, 281 R, 289 R, DIG. 14, 170 EB

[56] References Cited

U.S. PATENT DOCUMENTS

| | | | |
|---|---|---|---|
| 2,560,102 | 7/1951 | Guinn | 51/170 EB |
| 2,976,652 | 3/1961 | Bedortha et al. | 51/170 EB |
| 3,049,841 | 8/1962 | Guinn | 51/170 EB |
| 3,566,549 | 3/1971 | Britton | 51/170 EB |
| 4,249,346 | 2/1981 | Theurer | 51/178 |
| 4,768,312 | 9/1988 | Williams | 51/178 |
| 4,896,460 | 1/1990 | Theurer | 51/178 |

*Primary Examiner*—Roscoe V. Parker
*Attorney, Agent, or Firm*—Toren, McGeady & Associates

[57] ABSTRACT

A method for grinding the running and/or guide surfaces of rails or the like, where the running surfaces are ground by an endless revolving abrasive belt which can be moved against the running surfaces, wherein the abrasive belt revolves transversely to the longitudinal axis of the rail and embraces, at least partially with prestress, the running and/or guide surfaces. An apparatus for performing the method includes a mobile grinding machine, which an endless abrasive belt, guided at least on one rail of the track, which abrasive belt revolves over a drive roller and a reversal arranged at a distance therefrom and which can be moved by these against the surfaces of the rail to be ground. The reversal is formed of two reversing rollers which have a comparatively small spacing from each other, that the axes of the reversing rollers and of the drive roller 19 being arranged to be parallel to the longitudinal axis of the rail. Thus, the abrasive belt revolves transversely to the longitudinal axis of the rail and at least one reversing roller can be lowered beneath the upper edge of the running surface of the rail for partially embracing the surfaces of the rail.

22 Claims, 1 Drawing Sheet

METHOD AND APPARATUS FOR GRINDING THE RUNNING AND/OR GUIDE SURFACES OF RAILS OR THE LIKE

BACKGROUND OF THE INVENTION

The invention is directed to a method for grinding a rail head surface which consists of a running surface, a rounding off of the head and outer surfaces, the so-called running and guide surfaces of rails or the like, where the running and/or guide surfaces are ground by an endless revolving abrasive belt movable against the surfaces, as well as an apparatus for performing this method.

The machining of the running and guide surfaces of rails, and this applies to wide bottom flange rails as well as to streetcar rails, assumes a constantly increasing significance within the framework of rail improvement and conservation.

Welding beads as formed, for example, by thermite welding, excess welding deposit, which occurs in electric build-up or resurfacing welding of new rails as well as rail sections to be repaired, however also undulations or rail corrugations causing unevenness in the running or guide surfaces of rails used for railroad tracks, which impair the rolling properties of rail-borne vehicles to a large extent, are removed by the grinding process.

A mobile rail grinding machine for performing such a grinding process is known from DE-OS 28 01 110, where the running surface is machined, in accordance with the embodiment in FIG. 6 of that reference, by an endless abrasive revolving grinding belt, which is pressed against the running surface of the rail. Herein the grinding belt is supported on the one hand by a drive roller and on the other hand by an additional roller serving for reversal arranged to be spaced from the driver roller. Both these rollers are rotatable around a horizontal axis which extends transversely to the longitudinal axis of the rail. This means that the abrasive belt revolves in the direction of the rail and thus in the travel direction or counter to the travel direction of the machine. The drive roller as well as the reversing roller are either entirely cylindrical or designed to be slightly arched outwardly or convex for better guidance of the abrasive belt. This entails that such a grinding process exclusively leaves an even surface on the running surface of the rails and removes unevenness or welding beads only in this region.

In order to completely machine, for instance, convex running surfaces, several such grinding units are arranged consecutively in the machine and each successive grinding unit is rotated with respect to the preceding grinding unit through several angular degrees in the longitudinal direction of the rail. After this method of machining, the running surfaces consist of several flat surfaces respectively inclined with respect to each other by several angular degrees, which approach very closely the desired shape of the running surface, however, without ever reaching same. The running surface will always have a polygonal cross-section. Furthermore, such a grinding method has the considerable disadvantage that the detached grinding dust moves or flies in the longitudinal direction of the rail and can cling to the rail or its running surface This previously known device entails considerable financial expense and is in spite of that unsuitable for machining welding beads at rail connections and for short pieces of rail which are repaired prior to installation by resurfacing by welding.

A device for grinding the running surface of rails is also known from EP-PS 0 110 246, which has a considerably simpler and therefore more economical construction. Here also the head or running surface is machined by means of an endless revolving abrasive belt, which is guided by a drive roller and a contact pressure roller which are both rotatable around a horizontal axis extending transversely to the rail. Thus, in this case also the abrasive belt revolves in the longitudinal direction of the rail, so that also in this case there always exists a polygonal head or running surface after the machining or grinding process. According to the embodiment in FIG. 4 of EP-PS 0110 246, the contact pressure roller is indeed designed as a profile roller, whose free cross-section corresponds to the running surface of a rail head. Such a profile contact pressure roller results, however, in an undesirable stretching in the edge regions of the abrasive belt, which entails a very rapid wear or a quick destruction of the abrasive belt. This is the reason why such a profile contact pressure roller is not used in actual practice.

SUMMARY OF THE INVENTION:

Accordingly, it is an object of the present invention to provide a method which permits grinding of the running and/or guide surfaces of rails without difficulties and at low cost and eliminates the formation of polygonal surfaces.

Pursuant to this object, and others which will become apparent hereafter, one aspect of the present invention resides in a method in which the running and/or guide surfaces of the rail are ground by an abrasive belt revolving transversely to the longitudinal axis of the rail and at least partially embracing the running and/or guide surfaces with prestress. Such a grinding method assures the machining of both arched and convex surfaces of the rails. Polygonal surfaces which resulted from previously known methods do not occur with the present process. The method can be performed with butt connections, with build-up welding, and for removal of undulations and/or groove-shaped unevenness. Streetcar rails can also be easily treated in accordance with this method.

In a further embodiment of the inventive method, the prestress on the belt is adjustable.

An apparatus pursuant to the present invention, for performing the above method, includes an endless abrasive belt guided on at least one rail. The belt revolves over a drive roller and reversing rollers, spaced from the drive roller, and is movable by the rollers against the surfaces to be ground. The reversing rollers and drive roller have axes parallel to the longitudinal axis of the rail so that the belt revolves transversely to the longitudinal axis of the rail. At least one of the reversing rollers is lowerable beneath the upper edge of the running surface of the rail so as to partially embrace the surface.

In a further embodiment of the inventive apparatus the drive roller and the reversing rollers are arranged on a raisable and lowerable trolley. In still another embodiment the trolley is arranged on a horizontally displaceable guide plate.

In another embodiment the belt is stretched or stressed by a roller. The drive roller being useable as the stretching roller.

In yet another embodiment, the reversing rollers are arranged on a pivotable bracket.

The novel features which are considered as characteristic for the invention are set forth in particular in the appended claims The invention itself, however, both as to its construction and its method of operation, together with additional objects and advantages thereof, will be best understood from the following description of specific embodiments when read in connection with the accompanying drawing.

BRIEF DESCRIPTION OF THE PREFERRED EMBODIMENTS

Figure 1:
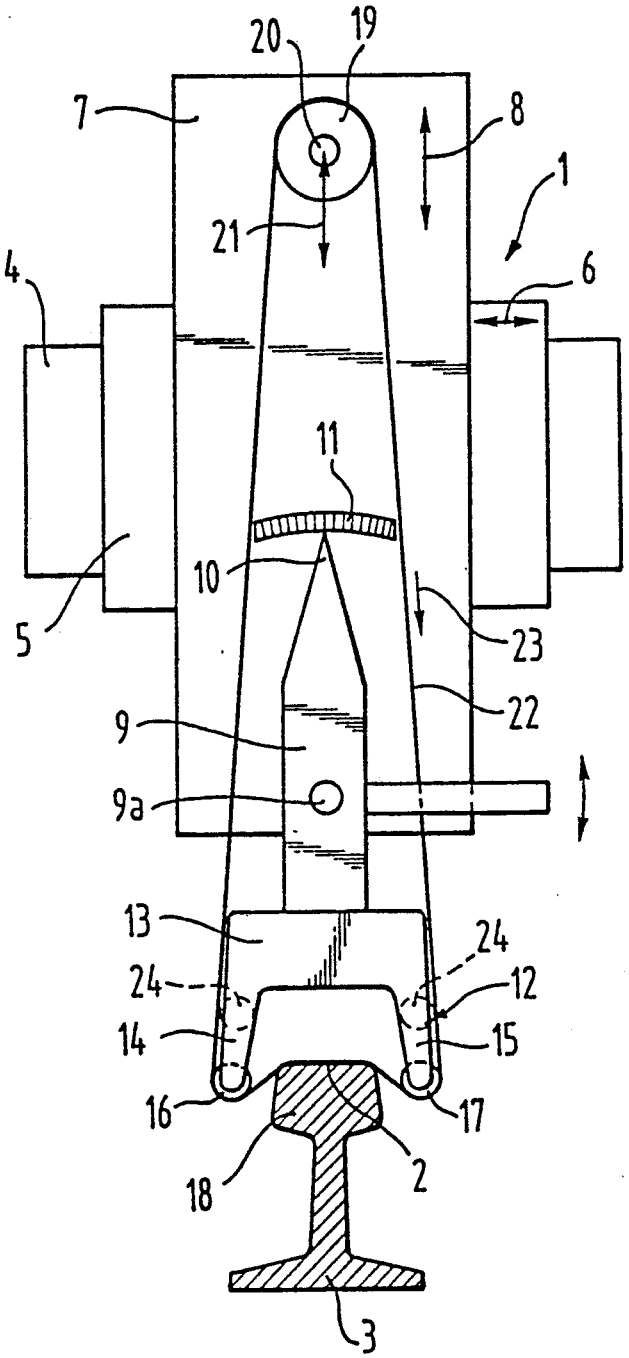
FIG. 1 shows the essential parts of an apparatus pursuant to the present invention, in elevation.

Only one guiding device 4 is shown in FIG. 1 for an apparatus 1 for machining a running surface 2 of a rail 3 by grinding. The guidance device 4 is supported, in a known such and not depicted manner, in a stand which can be moved, for instance, by four revolving rollers manually or by means of a special drive on a rail track or a piece of a rail track consisting of two rails 3.

The guiding device 4 has a guide plate 5 which can be displaced upon the guiding device 4 horizontally, in the direction of the twin arrow 6, manually or by means of a special drive wheels is known in the art. Preferably, the displacement is accomplished by means of a threaded spindle with an assigned nut. A trolley 7 is arranged on the guide plate 5, and can be raised or lowered in a non-depicted guidance mechanism in the direction of the twin arrow 8. The raising or lowering of the trolley 7 occurs, for instance, by means of a threaded spindle connected with a drive motor, which both have not been depicted here.

The trolley 7 carries a horizontal journal 9*a*, which extends perpendicularly to the plane of the drawing, at its lower end, upon which a journal lever 9 is pivotably attached. The pivoting of the lever 9 can occur for instance also by a non-depicted threaded spindle which is turned manually or by a mechanical drive The upper end of the lever 9 is configured as a pointer 10, which cooperates with a graduation 11, which has only been outlined here The lever 9 can be set to a predetermined angular position on this scale or graduation 11 in a simple manner.

The lower end of the lever 9 carries an approximately V-shaped bracket or stirrup 12 which in this embodiment is formed by two plates 13 connected with each other at a predetermined spacing. These plates 13 are arranged perpendicularly to the plane of the drawing to be one behind the other, so that only the front plate 13 can be seen. The two plates 13 are connected with the lever 9 either by bolts or by welding. One reversing roller 16, 17, respectively, is arranged rotatably at the ends of the legs 14, 15 of the bracket 12 between the two legs 14, 15 of both plates 13. Each reversing roller 16, 17, is for instance, made up of several ball bearings arranged next to each other upon an axis. The spacing between the two reversing rollers 16, 17 and with this also between the two legs 14, 15 of the bracket 12, is slightly greater than the width of the head 18 of the rail 3.

A drive roller 19 fastened on a shaft 20 of a non-depicted conventional drive motor is located at the upper end of the trolley 7. The drive motor with the drive roller 19 is supported by a non-depicted console which is guided at the trolley 7 so as to be raisable and lowerable. This console is moved in the direction of the twin arrow 21 by an also not-depicted pneumatic spring, for instance a piston cylinder unit which can be acted upon by pneumatic pressure. In the lower position of the drive roller 19 an endless abrasive belt 22 is placed over the roller, and is sufficiently large or long that it can also be conducted over the two reversing rollers 16, 17. Subsequently, the drive roller 19 is moved upwards so that the abrasive belt 22 is stressed or stretched. This stress entails that the abrasive belt 22 runs in a straight line between the two reversing rollers 16, 17.

In operation, the apparatus 1 described above is placed with its non-depicted rollers upon a rail track or a piece of rail track in order to machine the rail 3 and subsequently the guide plate 5 is moved horizontally so that the bracket 12 and with it also the trolley 7 are located centrally above the rail 3. After this, the trolley 7 is moved downwards to a point where the lower face of the two revolving rollers 16, 17 is located by a predetermined dimension below the running surface 2 of the track rail. Because of the stress or the prestress on the drive roller 19, the drive roller moves 19 downwards so that the abrasive belt 22 can assume the position between the two reversing rollers 16, 17 depicted in FIG. 1, in which the running surface 2 is completely embraced or covered by the abrasive belt 22 over its entire width in spite of its arching or convexity. During this motion of the trolley 7 the motor of the drive roller 19 is expediently switched on, so that the abrasive belt 22 revolves in the direction of the arrow 23. The revolving abrasive belt 22 grinds the running surface 2 of the track rail 3, and the apparatus 1 can also be displaced in the axial direction of the rail track 3, if desired. A desired arching or convexity of the rolling surface 2 is generated as a function of the stress or amount of stretch of the abrasive belt 22 and height position of the reversing roller 16, 17.

As has already been stated above, the bracket 12 and with it also the trolley 7 are located centrally above the rail 3, so that a symmetrical running surface 2 is generated. By appropriate horizontal displacement of the guide plate 5 and/or pivoting of the bracket 12 around the journal 9*a* of the lever 9 an asymmetrically extending running surface 2 of the rail 3 can be produced. Such a displacement or pivoting also occurs, for instance, if the rolling surface of a grooved rail is being ground. In this case one reversing roller 16 or 17 with a correspondingly small diameter projects into the groove of one rail. Depending upon the pivot angle of the bracket 12 it can be necessary to provide additional guide rollers 24 at or between the legs 14, 15 of the plates 13. These additional guide rollers 24 are outlined in FIG. 1 and are meant to ensure that the abrasive belt 22 does not come into contact in an undesirable manner with the bracket 12, the lever 9 or with other parts and thus could be destroyed.

Figure 2:
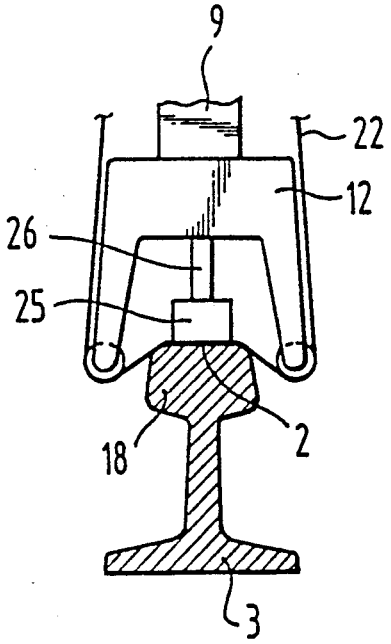
FIG. 2 shows a particular design of a bracket with reversing rollers corresponding to the apparatus of FIG. 1.

A pressure plate 25 is provided at the bracket 12 in the embodiment of FIG. 2, which pressure plate 25 is pressed by a pressure member 26 which is, for instance, a piston cylinder unit acted upon by pneumatic pressure, against the rolling surface of the rail 3. This pressure must herein be selected in such a way, that the abrasive belt 22 does not wear too rapidly. The shape of the running surface 2 of the rail 3 can be influenced as a function of the shape of the pressure surface and the width of the pressure plate 25. The pressure plate 25 can be equipped with channels through which a cooling agent of a cooling circuit passes in order to avoid an undesirable heating of the pressure plate 25.

The grinding dust removed from the running surface 2 by the abrasive belt 22 is evacuated towards the sides and does not return to the running surface 2. Impairments of the running surface 2 possibly caused by this dust are therefore eliminated.

By way of a change of the embodiment just described it is also possible to arrange the drive roller 19 and its motor to be stationary and to provide additionally a special stretching roller for the abrasive belt 22. If necessary, the bracket 12 can also be rigidly connected with the trolley 7 or the guide plate 5. The motion of the bracket 12, the drive roller 19 or the stretching roller, the trolley 7 and the guide plate 5 can occur by means of a program control known as such.

While the invention has been illustrated and described as embodied in a method and apparatus for grinding the running surfaces of rails, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A method for grinding running and/or guide surfaces of a longitudinal rail, comprising the steps of grinding the rail with an endless revolving abrasive belt by moving the belt against the running surfaces of the rail, the belt revolving transversely to the longitudinal axis of the rail, and embracing the running and/or guide surfaces at least partially with a prestress.

2. A method according to claim 1, including completely embracing the running and/or guide surfaces of the rail with the abrasive belt.

3. A method according to claim 1, including adjusting the prestress of the belt.

4. An apparatus for grinding running and/or guide surfaces of a longitudinal rail comprising:

mobile grinding means including an endless abrasive belt guided at least on one rail;

a drive roller;

reversing means spaced from the drive roller, the endless belt being arranged so as to revolve over the drive roller and reversing means and being movable thereby against the surfaces to be ground, the reversing means including reversing rollers with a comparatively small spacing from each other, the reversing roller and the drive roller having axes parallel to the longitudinal axis of the rail so that the abrasive belt revolves transversely to the longitudinal axis of the rail, at least one of the reversing rollers being lowerable beneath an upper edge of the running surface of the rail so as to partially embrace the surface of the rail;

a drive motor for the drive roller; and a raisable and lowerable trolley, the drive roller with drive motor and the two reversing rollers being arranged on the raisable and lowerable trolley.

5. An apparatus according to claim 4, and further comprising a horizontally displaceable guide plate upon which the trolley is arranged.

6. An apparatus according to claim 4, and further comprising a stretching roller assigned to the abrasive belt.

7. An apparatus according to claim 6, and further comprising a spring assigned to the stretching roller.

8. An apparatus according to claim 7, wherein the spring is a pneumatic pressure spring.

9. An apparatus according to claim 7, wherein the spring is a piston-cylinder unit which can be acted upon by pneumatic pressure.

10. An apparatus according to claim 6, wherein the stretching roller and the drive roller are a single roller.

11. An apparatus according to claim 4, and further comprising a pivotable bracket, the two reversing rollers being arranged on the pivotable bracket.

12. An apparatus according to claim 11, wherein the bracket is one of U- and V-shaped and has legs, the reversing rollers being supported at ends of the legs of the bracket.

13. An apparatus according to claim 11, wherein the bracket is formed by two plates spaced from each other, the reversing rollers being supported between the two plates.

14. An apparatus according to claims 12, and further comprising at least one guide roller assigned to each reversing roller.

15. An apparatus according to claim 14, wherein the at least one guide roller is supported at the legs of the bracket so as to be spaced from the reversing rollers.

16. An apparatus according to claim 12, wherein at least one of the reversing rollers and the at least one guide roller are formed by at least two ball or roller bearings arranged next to each other.

17. An apparatus according to claim 4, and further comprising a pressure plate arranged between the two reversing rollers so as to cooperate with the abrasive belt.

18. An apparatus according to claim 17, and further comprising a pressure member assigned to the pressure plate.

19. An apparatus according to claim 18, wherein the pressure member is a spring.

20. An apparatus according to claim 18, wherein the pressure member is a piston cylinder unit which can be acted upon by hydraulic or pneumatic pressure.

21. An apparatus according to claim 17, wherein the pressure plate has a profiled pressure surface.

22. An apparatus according to claim 17, and further comprising a cooling circuit, the pressure plate being connected to the cooling circuit.

* * * * *